US007294972B2

(12) United States Patent
Chou et al.

(10) Patent No.: US 7,294,972 B2
(45) Date of Patent: Nov. 13, 2007

(54) FEEDBACK CIRCUIT FOR PUSH-PULL INVERTERS

(75) Inventors: Chin-Wen Chou, Taipei Hsien (TW); Ying-Nan Cheng, Taipei Hsien (TW); Chin-Biau Chung, Taipei Hsien (TW)

(73) Assignee: Zippy Technology Corp., Taipei Hsien (TW)

( * ) Notice: Subject to any disclaimer, the term of this patent is extended or adjusted under 35 U.S.C. 154(b) by 298 days.

(21) Appl. No.: 11/181,881

(22) Filed: Jul. 15, 2005

(65) Prior Publication Data

US 2007/0013320 A1 Jan. 18, 2007

(51) Int. Cl.
*H05B 37/00* (2006.01)

(52) U.S. Cl. ..... 315/219; 315/220; 315/224; 315/DIG. 5

(58) Field of Classification Search ..... 315/224, 315/219, 220, 221, DIG. 5, DIG. 7
See application file for complete search history.

(56) References Cited

U.S. PATENT DOCUMENTS 4,392,087 A * 7/1983 Zansky ..... 315/219
4,523,131 A * 6/1985 Zansky ..... 315/307
6,087,757 A 7/2000 Honbo et al.
6,724,126 B2 4/2004 Chou
2004/0239260 A1* 12/2004 Nakano ..... 315/246

* cited by examiner

*Primary Examiner*—David H. Vu
(74) *Attorney, Agent, or Firm*—Birch, Stewart, Kolasch & Birch, LLP

(57) ABSTRACT

A feedback circuit for push-pull inverters aims to improve the existing push-pull inverters that provide input electricity to a discharge lamp at a phase difference of 180 degrees without feedback electricity to regulate frequency signals and cannot effectively control uniform luminance of the discharge lamp. The invention includes a feedback device to get a detection electricity of the driving electricity of the discharge lamp through non-contact coupling induction. The detection electricity is transformed by the feedback device and output to a frequency control unit. The control unit can regulate and output the frequency signal in response to the luminance of the discharge lamp to timely adjust input electricity of a push-pull inverter.

7 Claims, 4 Drawing Sheets

FEEDBACK CIRCUIT FOR PUSH-PULL INVERTERS

FIELD OF THE INVENTION

The present invention relates to a feedback circuit for push-pull inverters and particularly to a non-contact induction electric feedback device for a push-pull inverter which drives a discharge lamp by providing input electricity on two ends of the discharge lamp at a phase difference of 180 degrees that can regulate input electricity and maintain uniform luminance of the discharge lamp.

BACKGROUND OF THE INVENTION

To improve illumination result and increase input electricity of discharge lamps, the driving method of using a push-pull inverter to ignite a discharge lamp by providing electricity at a phase difference of 180 degrees on two input electrodes at two ends of the discharge lamp has become an important technique. U.S. Pat. No. 6,087,757 discloses such a technique. It has a control unit to provide a driving frequency which alters input electricity to a transformer by 180 degrees of phase difference through a phase inversion circuit. U.S. Pat. No. 6,724,126 also discloses a technique which has a control unit to output frequencies of the same phase and two transformers of opposite polarity to generate input electricity at a phase difference of 180 degrees.

While the aforesaid patents have included discussion of the push-pull inverter, the two ends of the discharge lamp receive input electricity from the inverter. The discharge lamp cannot feed back the actual driving electricity condition through a coupling circuit to the control unit. In fact, after the discharge lamp has been used for a period of time, the discharge gas ages or input electrodes oxidize. As a result, the luminance of the discharge lamp becomes not uniform. If there is no feedback electricity sending timely to the control unit to adjust the driving frequency, aging of the discharge lamp will accelerate.

U.S. Pat. No. 6,087,757 provides a solution which connects the output side of the transformer to a lamp current detection device to get a feedback electricity detection value. It adopts a contact circuit which is not adaptable to the push-pull inverter.

SUMMARY OF THE INVENTION

The primary object of the present invention is to solve the aforesaid problems. The invention employs non-contact induction to get the detection electricity of the driving electricity of a discharge lamp. The detection electricity is transformed and feeds back to a control unit so that the frequency signal to maintain the required luminance of the discharge lamp can be adjusted instantly. As the invention uses non-contact coupling induction to get the detection electricity, any input electricity passing circuit may be employed in the circuit design. The invention is applicable to any type of push-pull inverters.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
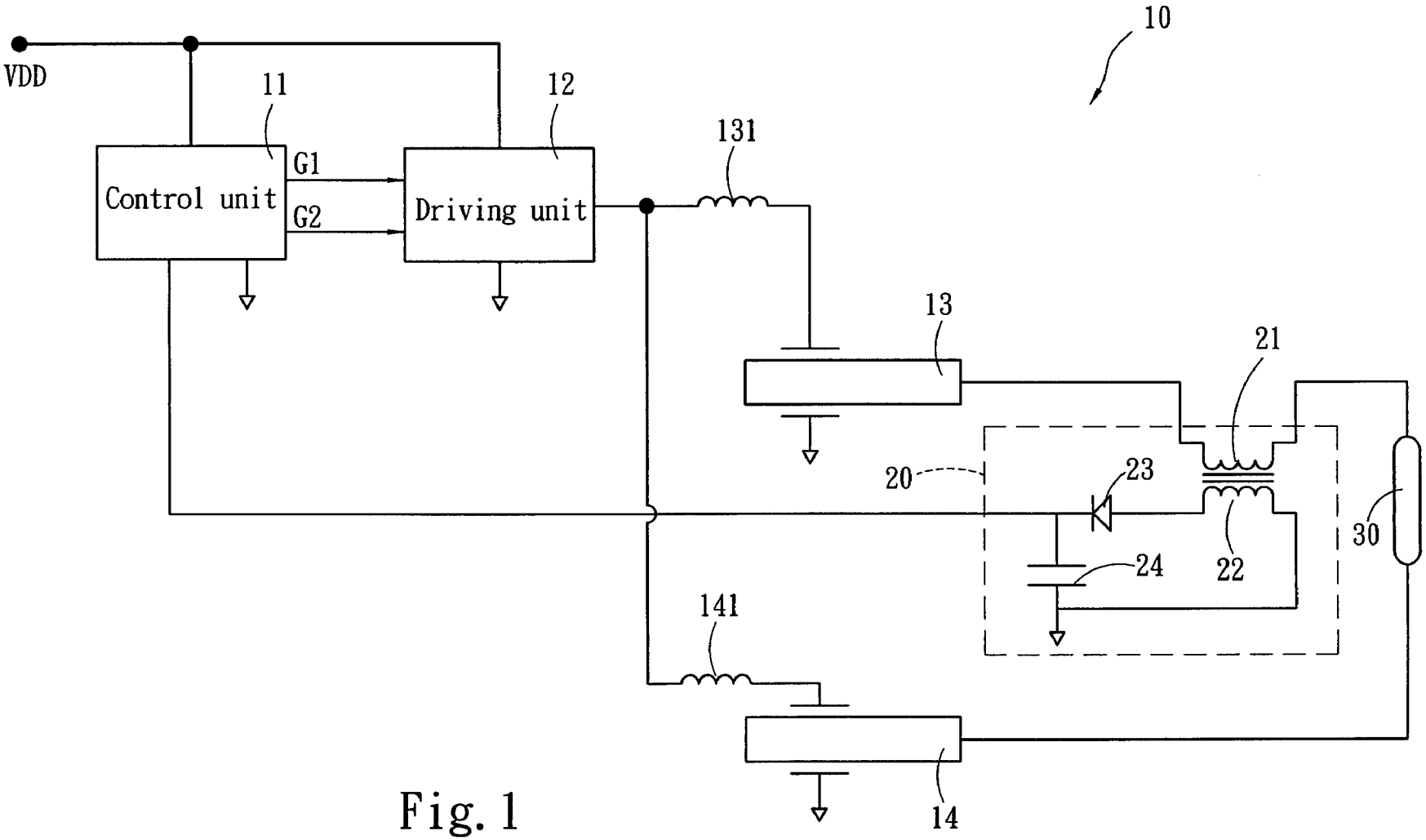
FIG. 1 is a circuit diagram of a first embodiment of the present invention.

Please refer to FIG. 1 for a first embodiment of the invention. The invention is adopted for use on a push-pull inverter 10 which includes a first transformer 13 and a second transformer 14 connecting to input electrodes at two ends of a discharge lamp 30. The first transformer 13 and the second transformer 14 provide input electricity to the discharge lamp 30 at a phase difference of 180 degrees. The discharge lamp 30 may be, but not limited to, an EEFL or CCFL. There is a control unit 11 (PWM) on the front end of the first transformer 13 and the second transformer 14 to output frequency signals G1 and G2 and a driving unit 12 (MOS) to receive the frequency signals G1 and G2 and output an electricity conduction signal to drive the first transformer 13 and the second transformer 14. In the following embodiments piezoelectric transformers are used as examples. The driving unit 12 and the first transformer 13 and the second transformer 14 are bridged respectively by induction elements 131 and 141 to transform the waveform of the electricity conduction signal (from a square wave to a sinusoidal wave). In the invention, there is a feedback device 20 located on the power cord between the driving unit 12 and the discharge lamp 30. The feedback device 20 includes a first coil assembly 21 on the power cord and an external second coil assembly 22 corresponding to the first coil assembly 21 that is electrically connected to the control unit 11. The feedback device 20 gets a detection electricity of the driving electricity of the discharge lamp 30 through non-contact coupling induction. The feedback device 20 transforms the detection electricity to an output feeding to the control unit 11 so that the control unit 11 can adjust output of the frequency signals G1 and G2 responding to the luminance of the discharge lamp 30.

In the first embodiment, the first coil assembly 21 is located between the first transformer 13 and the discharge lamp 30. The second coil assembly 22 and the control unit 11 are interposed by a rectification element 23 and a filter element 24. When the driving electricity of the discharge lamp 30 passes through the first coil assembly 21, the second coil assembly 22 gets a detection electricity from external direct electromagnetic induction according to the coil ratio of the first coil assembly 21 and the second coil assembly 22. The detection electricity passes through the rectification element 23 and the filter element 24 to be rectified and filtered, and inputs to the control unit 11. The control unit 11, according to the driving electricity of the discharge lamp 30 for generating the required luminance, outputs a duty frequency to the first transformer 13 and the second transformer 14 to determine the voltage boosting ratio. Thereby a uniform luminance and stable regulation can be achieved for the discharge lamp 30.

Figure 2:
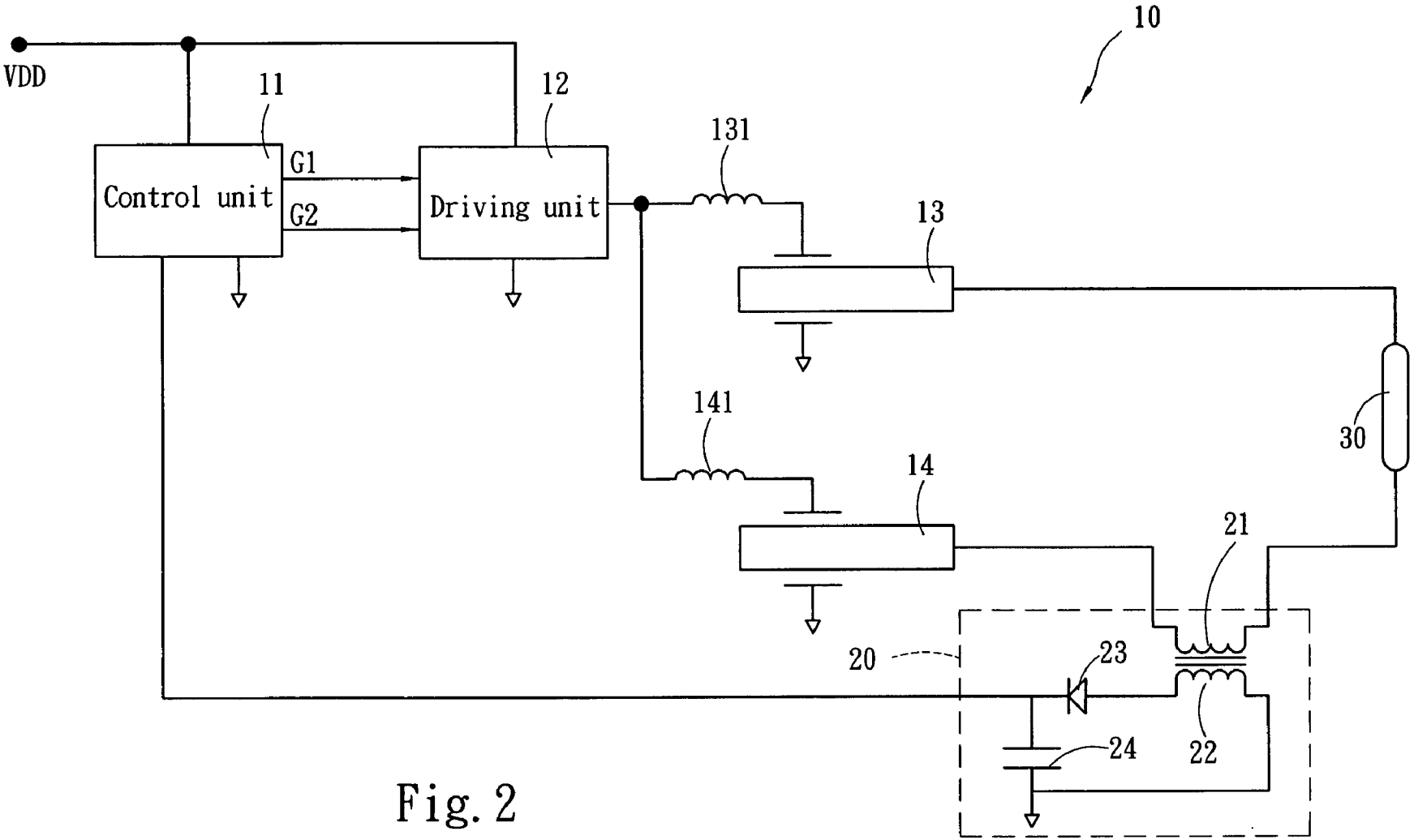
FIG. 2 is a circuit diagram of a second embodiment of the present invention.
Figure 3:
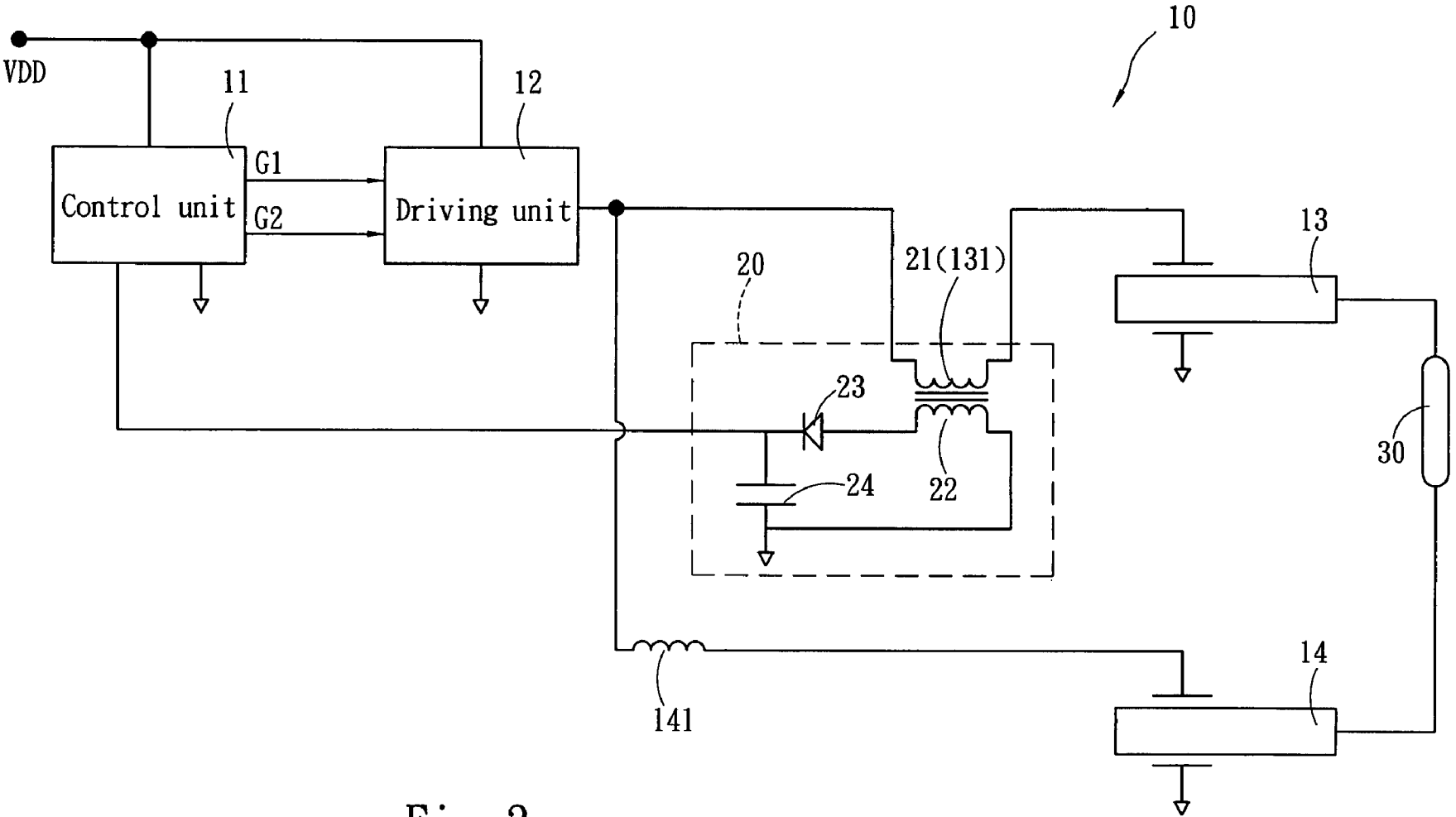
FIG. 3 is a circuit diagram of a third embodiment of the present invention.
Figure 4:
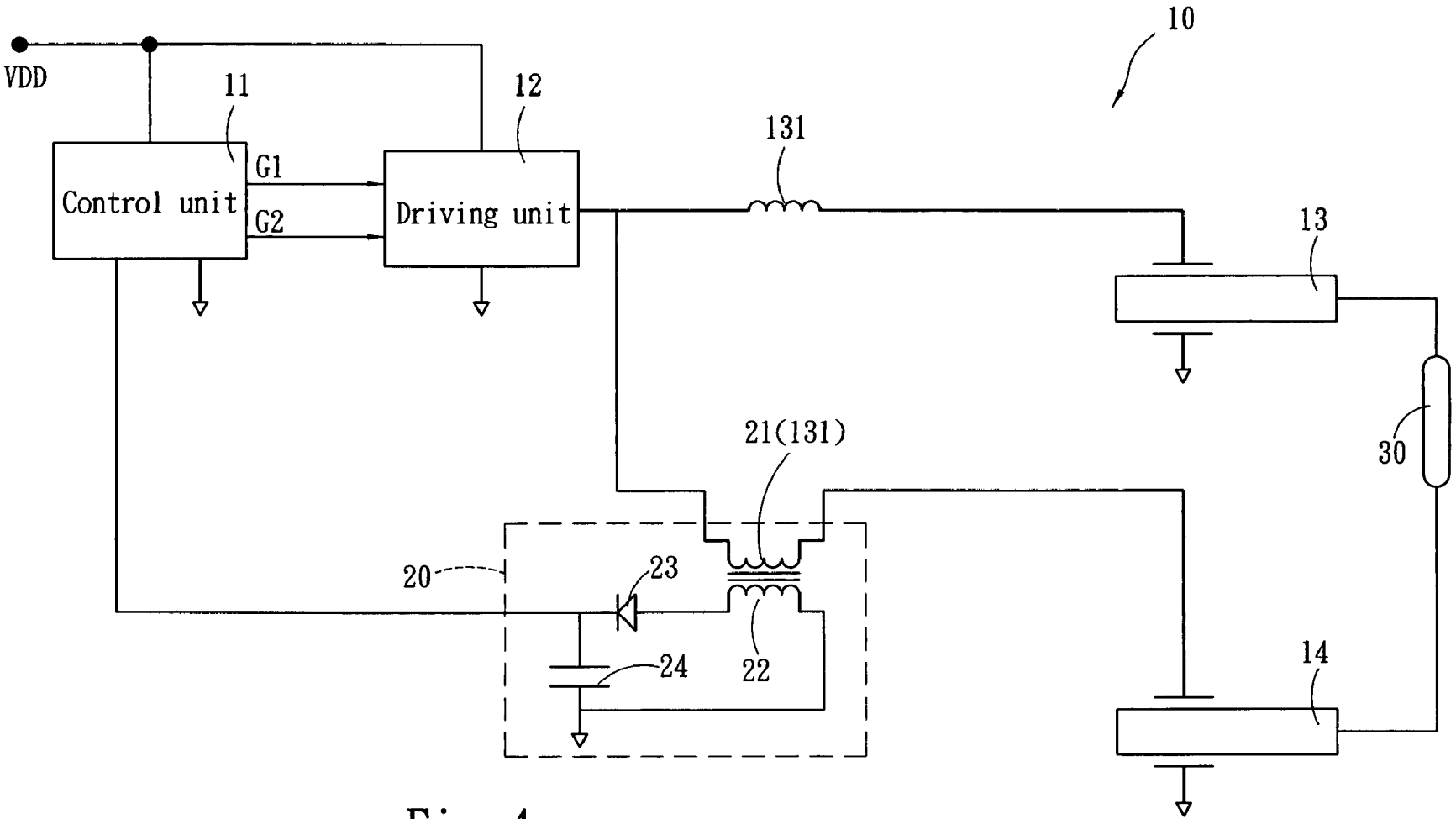
FIG. 4 is a circuit diagram of a fourth embodiment of the present invention.

Refer to FIG. 2 for the circuit diagram of a second embodiment of the invention. The feedback device 20 is located between the second transformer 14 and the discharge lamp 30. FIG. 3 illustrates the circuit diagram of a third embodiment of the invention. The feedback device 20 is located between the driving unit 12 and the first transformer 13. FIG. 4 shows the circuit diagram of a fourth embodiment of the invention. The feedback device 20 is located between the driving unit 12 and the second transformer 14. All the aforesaid circuits are operated the same way as the first embodiment does, and get the feedback detection electricity of the driving electricity of the discharge lamp 30 through a non-contact coupling. Hence a feedback is sent to the control unit 11 to make effective regulation in response to the luminance of the discharge lamp 30. In the third and fourth embodiments, the first coil assembly 21 is replaced by the existing induction elements 131 and 141 to simplify total circuit design.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A feedback circuit for a push-pull inverter which includes a first transformer and a second transformer connecting to input electrodes at two ends of a discharge lamp, the first transformer and the second transformer providing input electricity to the discharge lamp at a phase difference of 180 degrees, a control unit being provided in front of the first transformer and the second transformer to output frequency signals, and a driving unit being provided in front of the first transformer and the second transformer to receive the frequency signals and output an electricity conduction signal to drive the first transformer and the second transformer, characterized in that a feedback device is located on a power cord between the driving unit and the discharge lamp, the feedback device includes a first coil assembly on the power cord and an external second coil assembly corresponding to the first coil assembly and is connected electrically to the control unit, the feedback device gets a detection electricity of the driving electricity of the discharge lamp through non-contact coupling induction, and the detection electricity is transformed by the feedback device and output to the control unit to regulate the frequency signals in response to the luminance of the discharge lamp.

2. The feedback circuit for a push-pull inverter of claim 1 further having a rectification element and a filter element between the second coil assembly and the control unit.

3. The feedback circuit for a push-pull inverter of claim 1, wherein the first coil assembly is located between the driving unit and the first transformer.

4. The feedback circuit for a push-pull inverter of claim 1, wherein the first coil assembly is located between the driving unit and the second transformer.

5. The feedback circuit for a push-pull inverter of claim 1, wherein the first coil assembly is an induction element to transform the waveform of the electricity conduction signal.

6. The feedback circuit for a push-pull inverter of claim 1, wherein the first coil assembly is located between the first transformer and the discharge lamp.

7. The feedback circuit for a push-pull inverter of claim 1, wherein the first coil assembly is located between the second transformer and the discharge lamp.

* * * * *